US007242355B2

(12) United States Patent
Vance

(10) Patent No.: US 7,242,355 B2
(45) Date of Patent: Jul. 10, 2007

(54) FREQUENCY BAND SWITCHING OF AN ANTENNA ARRANGEMENT

(75) Inventor: Scott L. Vance, Staffanstorp (SE)

(73) Assignee: Sony Ericsson Mobile Communications AB, Lund (SE)

( * ) Notice: Subject to any disclaimer, the term of this patent is extended or adjusted under 35 U.S.C. 154(b) by 62 days.

(21) Appl. No.: 11/286,903

(22) Filed: Nov. 23, 2005

(65) Prior Publication Data

US 2007/0115186 A1 May 24, 2007

(51) Int. Cl.
*H01Q 3/24* (2006.01)
*H01Q 1/24* (2006.01)
*H01Q 19/00* (2006.01)

(52) U.S. Cl. ..... 343/702; 343/876

(58) Field of Classification Search ..... 343/700 MS, 343/702, 833, 876
See application file for complete search history.

(56) References Cited

U.S. PATENT DOCUMENTS 4,914,714 A * 4/1990 Tamura ..... 455/78
6,753,827 B2 * 6/2004 Oshiyama et al. ..... 343/876

* cited by examiner

*Primary Examiner*—Shih-Chao Chen
(74) *Attorney, Agent, or Firm*—Myers Bigel Sibley & Sajovec, P.A.

(57) ABSTRACT

A portable communication device includes an antenna arrangement in its interior. The antenna arrangement comprises at least one first radiating antenna element dimensioned for radiation in a first frequency band, and a first mechanically movable extension element, movable between at least two different fixed positions and being connected to the first radiating antenna element in at least one of the positions for radiating together with the first radiating antenna element. When the extension element is being moved from one position to another, it adjusts the electrical length of the combined first radiating antenna and extension element for enhancing radiation in a second frequency band. In this way a small sized multiband antenna arrangement is provided that keeps the efficiency of the different bands high.

24 Claims, 3 Drawing Sheets

FREQUENCY BAND SWITCHING OF AN ANTENNA ARRANGEMENT

FIELD OF THE INVENTION

The present invention relates to the field of antennas and more particularly to an antenna arrangement to be provided in the interior of a portable communication device and a portable communication device with such an antenna arrangement.

BACKGROUND OF THE INVENTION

There is a trend within the field of portable communicating devices, and especially within the field of cellular phones to have the antenna in-built in the phone itself. At the same time there is often a need for several frequency bands for such phones. The reasons for providing different frequency bands are several. First of all some networks provide several frequency bands in order to better distribute traffic in the network. GSM does for instance provide two separate bands that can be used. There are also different types of networks in different countries that use different frequency bands.

It is not a simple task to provide an antenna structure that can be used with good efficiency in several such bands, especially if the antenna is to be based on a PIFA antenna and provided in a stick type phone.

Various methods have been developed to achieve the additional bandwidth such as using parasitic elements that can be end coupled or side coupled, capacitively fed structures, ultra-high structures and electrically matched structures.

Parasitic elements can be useful in achieving additional bandwidth. They may be end coupled or coupled with parallel elements. When end coupling is used, it is necessary to have the space for two elements, which essentially doubles the required antenna volume. It has also been noted, particularly at low-band frequencies, that there is a tendency when parasitic elements are used for a low-gain region to occur in the frequencies between the resonant frequencies of the two resonators.

Several capacitively fed structures have been proposed. These structures can, in general, achieve the required bandwidth, but generally with a reduction in efficiency. When the bandwidth for instance at the low GSM band is doubled, a reduction in gain of 2–3 dB has generally been observed.

Ultra-high structures (13–15 mm in height) have shown promise in some Japanese products. The main problem with these devices is that they cause the overall size of the product to grow to what is often an unacceptable level.

Electrically matched structures have promise in theory. Currently there are a number of ways of accomplishing this, each with some drawbacks. PIN Diodes work well when properly biased. However, the necessary bias current to limit harmonic generation can lead to reduced standby and talk times. MEMS technology is in theory the best solution to eliminate harmonic and current consumption issues. However, currently devices are generally unavailable and highly sensitive to ESD. GaAs switches currently show the most promise. They have insertion loss of around 0.3 to 0.5 dB. The use of such structures furthermore adds to the cost of the product and require additional power, which it is necessary to keep as low as possible in a portable communication device. Since switching between some bands is only required very seldom, like for instance when travelling from Europe to USA, the use of a fast switching, which electrically matched structures provide, is not an important factor.

SUMMARY OF THE INVENTION

Embodiments of the present invention solve the problem of providing an in-built antenna for a portable communication device, which requires little space and allows radiation in different frequency bands while keeping the efficiency of the different bands high.

According to some embodiments, an antenna arrangement is provided for a portable communication device, which requires little space and allows radiation in different frequency bands while keeping the efficiency of the different bands high.

According to a first aspect of the present invention, an antenna arrangement is provided in the interior of a portable communication device, the antenna arrangement comprising:

- at least one first radiating antenna element dimensioned for radiation in a first frequency band, and
- a first mechanically movable extension element, movable between at least two different fixed positions, being connected to the first radiating antenna element in at least one of the positions for radiating together with the first radiating antenna element, which extension element when being moved from one position to another adjusts the electrical length of the combined first radiating antenna and extension element for enhancing radiation in a second frequency band.

A second aspect of the present invention is directed towards an antenna arrangement including the features of the first aspect, further comprising a second radiating antenna element dimensioned for radiation in a third frequency band.

A third aspect of the present invention is directed towards an antenna arrangement including the features of the second aspect, wherein the first mechanically movable extension element is in proximity of the second radiating antenna element in one of the positions for aiding radiation of the second radiating antenna element.

A fourth aspect of the present invention is directed towards an antenna arrangement including the features of the second aspect, wherein the first mechanically movable extension element is in contact with the second radiating antenna element in one of the positions.

A fifth aspect of the present invention is directed towards an antenna arrangement including the features of the second aspect, further comprising a second mechanically movable extension element, movable between at least two different fixed positions, being connected to the second radiating antenna element in at least one of the positions for radiating together with the second radiating antenna element, which extension element when being moved from one position to another adjusts the electrical length of the combined second radiating antenna and second extension element for enhancing radiation in a fourth frequency band.

A sixth aspect of the present invention is directed towards an antenna arrangement including the features of the fifth aspect, wherein the two movable extension elements are joined to each other for simultaneous movement between different positions.

A seventh aspect of the present invention is directed towards an antenna arrangement including the features of the first aspect, wherein the first radiating antenna element is provided with two sections of differing lengths both provided adjacent a feeding section of the antenna arrangement and the mechanically movable extension element in one position bridges a gap between one such section and said feeding section.

An eighth aspect of the present invention is directed towards an antenna arrangement including the features of the first aspect, wherein the antenna arrangement is a PIFA antenna arrangement.

A ninth aspect of the present invention is directed towards an antenna arrangement including the features of the first aspect, wherein the mechanically movable extension element has a capacitive connection to radiating antenna elements.

A tenth aspect of the present invention is directed towards an antenna arrangement including the features of the first aspect, wherein the mechanically movable extension element has an electrical connection to radiating antenna elements.

According to some embodiments of the present invention, a portable communication device is provided having an antenna arrangement that requires little space and allows radiation in different frequency bands while keeping the efficiency of the different bands high.

According to an eleventh aspect of the present invention, a portable communication device is provided comprising in its interior:

an antenna arrangement including at least one first radiating antenna element dimensioned for radiation in a first frequency band, and a first mechanically movable extension element, movable between at least two different fixed positions, being connected to the first radiating antenna element in at least one of the positions for radiating together with the first radiating antenna element, which extension element when being moved from one position to another adjusts the electrical length of the combined first radiating antenna and extension element for enhancing radiation in a second frequency band.

A twelfth aspect of the present invention is directed towards a portable communication device including the features of the eleventh aspect, wherein the antenna arrangement further comprises a second radiating antenna element dimensioned for radiation in a third frequency band.

A thirteenth aspect of the present invention is directed towards a portable communication device including the features of the twelfth aspect, wherein the first mechanically movable extension element is in proximity of the second radiating antenna element in one of the positions for aiding radiation of the second radiating antenna element.

A fourteenth aspect of the present invention is directed towards a portable communication device including the features of the twelfth aspect, wherein the first mechanically movable extension element is in contact with the second radiating antenna element in one of the positions.

A fifteenth aspect of the present invention is directed towards a portable communication device including the features of the twelfth aspect, wherein the antenna arrangement further comprises a second mechanically movable extension element, movable between at least two different fixed positions, being connected to the second radiating antenna element in at least one of the positions for radiating together with the second radiating antenna element, which extension element when being moved from one position to another adjusts the electrical length of the combined second radiating antenna and second extension element for enhancing radiation in a fourth frequency band.

A sixteenth aspect of the present invention is directed towards a portable communication device including the features of the fifteenth aspect, wherein the two movable extension elements are joined to each other for simultaneous movement between different positions.

A seventeenth aspect of the present invention is directed towards a portable communication device including the features of the eleventh aspect, wherein the first radiating antenna element is provided with two sections of differing lengths both provided adjacent a feeding section of the antenna arrangement and the mechanically movable extension element in one position bridges a gap between one such section and said feeding section.

An eighteenth aspect of the present invention is directed towards a portable communication device including the features of the eleventh aspect, wherein all movable extension elements are connected to an actuating unit, which may be actuated by a user of the device.

A nineteenth aspect of the present invention is directed towards a portable communication device including the features of the eighteenth aspect, wherein the actuating unit is provided under the casing of the device for stopping a user from actuating said extension element.

A twentieth aspect of the present invention is directed towards a portable communication device including the features of the eighteenth aspect, wherein the actuating unit is provided on a surface of the portable communication device that is accessible to a user of the device.

A twenty-first aspect of the present invention is directed towards a portable communication device including the features of the eleventh aspect, wherein the antenna arrangement is a PIFA antenna arrangement.

A twenty-second aspect of the present invention is directed towards a portable communication device including the features of the eleventh aspect, wherein the mechanically movable extension element has a capacitive connection to radiating elements.

A twenty-third aspect of the present invention is directed towards a portable communication device including the features of the eleventh aspect, wherein the mechanically movable extension element has an electrical connection to radiating elements.

A twenty-fourth aspect of the present invention is directed towards a portable communication device including the features of the eleventh aspect, wherein it is a cellular phone.

According to embodiments of the present invention, multiband functionality is provided in a limited size antenna arrangement having a limited number of radiating antenna elements. Thus the antenna arrangement is small. The efficiencies of the different bands are furthermore kept high. According to some embodiments, the antenna arrangement also has low losses and is cheap to produce, which gives a low additional cost to the end product. There may be no power consumption associated with the extension element, which is also important for portable communication devices that are battery powered.

It should be emphasized that the term "comprises/comprising" when used in this specification is taken to specify the presence of stated features, integers, steps or components, but does not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION OF EMBODIMENTS OF THE INVENTION

A portable communication device according to embodiments of the invention will now be described in relation to a cellular phone. The phone may be a so-called stick-type phone, but can be other types of phones, like clam-shell phones or slider phones. The portable communication device can also be another type of device, like a communication module, a PDA or any other type of portable device communicating with radio waves.

Figure 1:
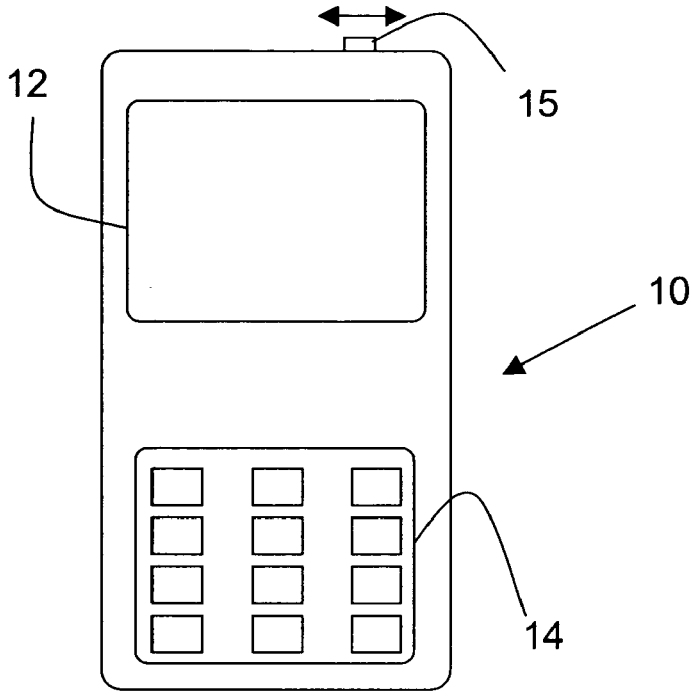
FIG. 1 schematically shows a front view of a stick-type phone according to the invention.

FIG. 1 schematically shows a front view of a stick-type phone according to the invention. The phone 10 includes a keyboard 12 and a keypad 14. Here it is worth noting that there is no antenna protruding from the phone. The antenna is in-built. There is however a button or actuating unit 15 on top of the phone which may be actuated by a user for using the antenna arrangement according to the present invention.

Figure 2:
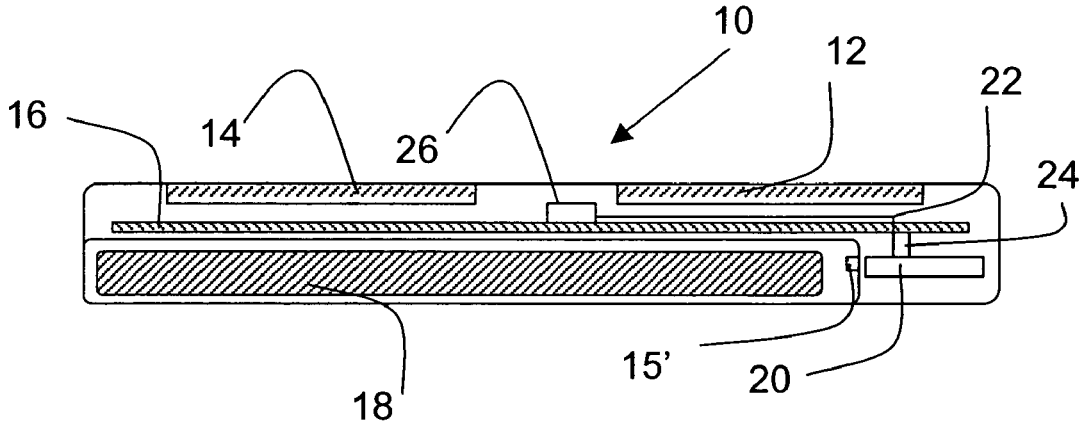
FIG. 2 shows a side view disclosing some of the components and elements in the phone of FIG. 1, FIGS. 3*a* and *b* schematically show an antenna arrangement according to a first embodiment of the present invention provided with a mechanically movable extension element, which has been moved between two positions, FIGS. 4*a* and *b* schematically show an antenna arrangement according to a second embodiment of the present invention provided with a mechanically movable extension element, which has been moved between two positions, FIGS. 5*a* and *b* schematically show an antenna arrangement according to a third embodiment of the present invention provided with two mechanically movable extension elements, which have been moved between two positions, and FIGS. 6*a–d* schematically show an antenna arrangement according to a fourth embodiment of the present invention provided with a mechanically movable extension element, which has been moved between four positions.

FIG. 2 schematically shows a side view of the relevant elements in the interior of the phone 10. On a front surface there is provided the keypad 14 and display 12. Below these elements there is provided a circuit board 16, on which there is provided a radio circuit 26. The radio circuit 26 is provided in order to feed an antenna arrangement 20 of the invention. The circuit board 16 also includes a ground plane (not shown) which stretches throughout the whole of the board 16. There are of course other components and elements provided on the circuit board 16. They have however been omitted in order to focus on the present invention, which is directed towards the antenna arrangement 20. Below the circuit board 16 close to a back surface of the phone there is provided a battery 18 in a battery compartment. The battery 18 is used for providing power to the phone. The battery 18 does essentially stretch from a bottom end of the phone and almost up to a top end of the phone. However the size and placing of the battery 18 is not central for the present invention. At this top end there is provided an antenna arrangement 20 according to the present invention. An alternative placement of the actuating unit 15' in this battery compartment is also shown in this figure. This placing is thus an alternative to the placing of the actuating unit in FIG. 1. The antenna arrangement 20 is provided below the display and the circuit board 16 and sideways in relation to the battery 18. The antenna arrangement 20 has a feeding line 22 connected to the radio circuit 26 for receiving radio signals for enabling transmission at suitable frequencies and a ground line 24 connected to the ground plane of the circuit board 16.

Figure 3A:
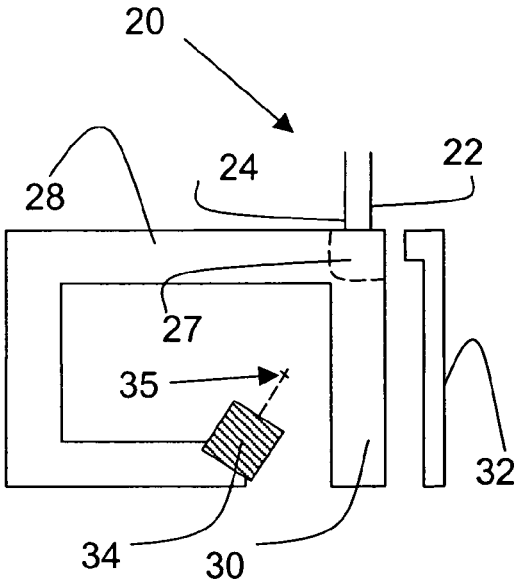
Figure 3B:
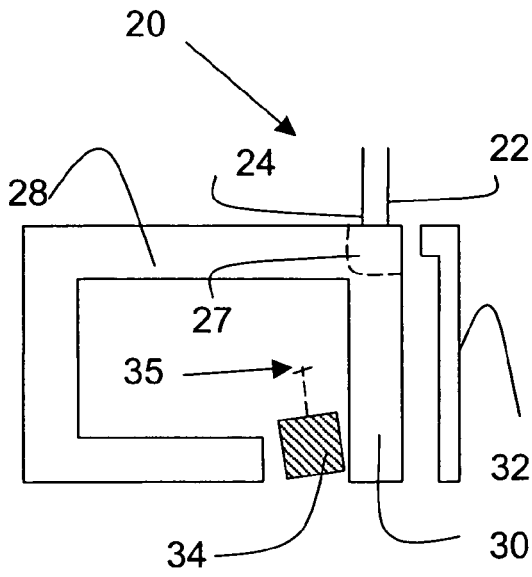

The antenna arrangement 20 according to a first embodiment of the present invention is schematically shown in FIGS. 3*a* and 3*b*. The antenna arrangement 20 is a multiband PIFA antenna arrangement. It is provided with a first radiating antenna element 28 which projects sideways straight out from a feeding section 27 where the feeding line 22 and ground line 24 are provided and is essentially shaped as a metallic strip having a first and a second 90-degree bend so that the element first stretches away sideways from the feeding section 27, then makes a 90 degree turn, thereafter stretches to a second 90-degree turn and then back essentially towards the feeding point 27. The first radiating antenna element 28 can also be seen as having a first straight section followed by an L-shaped section, where the L-section is connected to the first straight section at the first bend. The end of the L-section furthest away from the first bend is here a free end of the first radiating antenna element 28. The first radiating antenna element 28 can also be seen as being essentially U-shaped. This element 28 has a length and width that is dimensioned for radiation in a first frequency band, which in this embodiment is the frequency band of 900 MHz. It is also to be used for a second frequency band, which is the 850 MHz band. An essentially bar shaped second radiating antenna element 30 projects straight out from the feeding section 27 and is essentially perpendicular to the first straight section of the first radiating antenna element 28. The end of the second radiating antenna element 30 furthest away from the feeding section 27 is here a free end of this second radiating antenna element 30. This second radiating antenna element 30 has a length and width dimensioned for radiating in a third frequency band, which is here the 1800 MHZ band. There is finally a third antenna element 32, which is essentially parallel with the second radiating antenna element 30 and slightly thinner than the two radiating antenna elements 28 and 30. This third antenna element 22 is not connected to the feeding section. It is however separately connected to ground (not shown). This element 32 is a parasitic antenna element for enhancing radiation of the second radiating element when it transmits in a fourth frequency band, that is the 1900 MHz band. The antenna elements are normally printed metal strips on a foil, typically copper, but may also be provided as sheets of suitable metal. It should here be realised that the shape of these elements can be varied in a multitude of ways in order to be fit into a limited size area. What is important though is that they are dimensioned regarding length and width in order to radiate well in the different frequency bands.

According to embodiments of the present invention there is furthermore provided a first mechanically movable extension element 34 in the form of a plate of suitable metal (like copper). The extension element is made to turn between a first and a second position around a rotation point 35. In a first position, which is depicted in FIG. 3*a*, the extension element 34 is connected to the free end of the first radiating antenna element 28 and in a second position, which is depicted in FIG. 3*b*, it has been moved away from the free end of the first radiating antenna element close to the free end of the second radiating antenna element 30. The extension element 34 is in the first position, FIG. 3*a*, connected to the first radiating antenna element 28. By being connected to the first radiating antenna element 28 it extends the electrical length of the first antenna element so that it radiates together with the first radiating antenna element 28. Thereby the frequency is lowered and in this embodiment it is lowered to the 850 MHz band. In the second position, the movable extension element 34 is in proximity of the second radiating antenna element 30. By removing it from the first radiating antenna element 28, the electrical length is shorter than in the first position and thus the bandwidth is raised, and here raised to the 900 MHz band. The movement of the extension element 34 to the second position also has the effect of tuning the second radiating antenna element 30 lower, which is necessary because its resonance is tuned higher when extension element 34 is removed from being coupled to the first radiating antenna element 28. It is understood that some of the high-band currents associated with the resonance formed on the second radiating antenna element 30 occur on the first radiating antenna element 28 as well as a higher order resonance and tuning the first radiating antenna element 28 (in this case by moving extension element 34) has a secondary effect of tuning the resonance formed on the second radiating antenna element 30. Changes in length to the first radiating antenna element 28 generally do not have the same effect with respect to the resonance formed on the third antenna element 32. In any case, a movement of the extension element 34 from the second to the first position can furthermore also be seen as adjusting the electrical length of the combination of the first radiating antenna element 28 and the extension element 34 for enhancing radiation in the second frequency band, which is a neighbouring frequency band to the first frequency band.

The extension element 34 may be provided on a piece of plastic material. In order to provide turning round the turning point, the plastic material may be fastened via a pivot point to the phone. It should also be realised that the two positions may be fixed. Then is not possible to let the extension element take any position in-between or beyond these points. The reason for this is that this might be necessary to obtain the enhanced multiband functionality. The extension element is furthermore preferably capacitively connected to the first radiating antenna element in the first position. It is however possible also with an electrical connection, but then normally gold contacts are needed which makes the device unnecessarily expensive.

The extension element 32 may furthermore be connected to the actuating unit, which may consist of a lever, a button or any other suitable unit that may be actuated by the user for selecting the first or the second position of the extension element 34. This actuating unit may be provided on the exterior of the phone, for instance on the top side as is shown in FIG. 1. It may also be provided in the battery compartment as is shown in FIG. 2. The reason for this is that a change of position by a user should in essence only be made once the user makes a trip between for instance Europe and USA where different frequency bands are used. The user would then have to remove the battery in order to change position of the extension element. Thus he/she should not be invited to make changes often. This is why placing the actuating unit in the battery compartment is suitable. One may also wish to place markings on the casing in order to let the user know which position the extension element should be in depending on the usage case.

It might furthermore be suitable to place the actuating unit in the interior of the phone inside the casing, out of reach of the user, so that he cannot switch it himself. In this case the user would have to go to a service point in order for a serviceman to change position of the extension element.

Figure 4A:
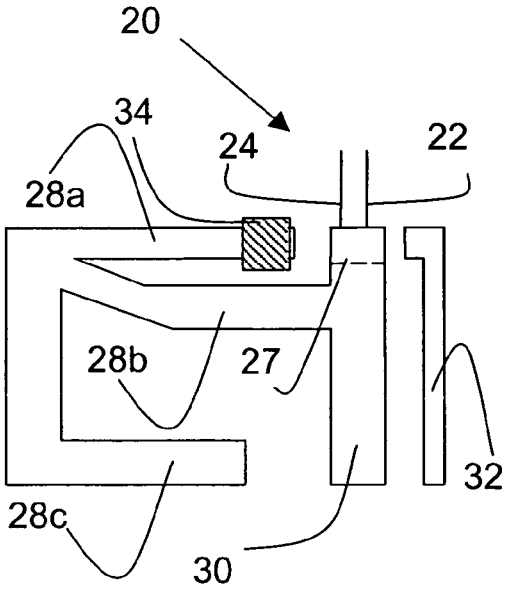
Figure 4B:
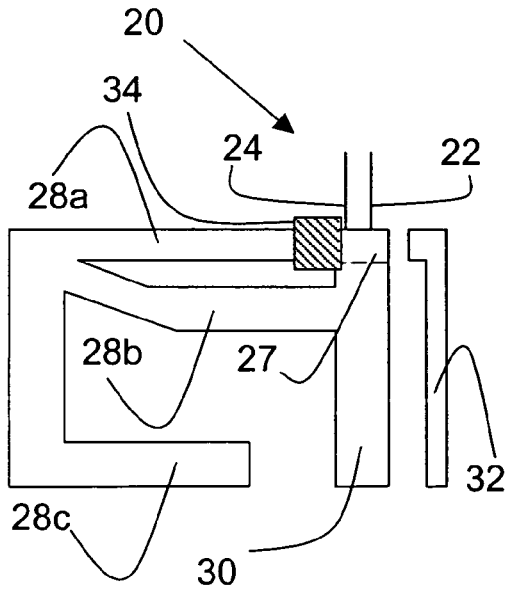

There are a number of possible variations that can be made of the present invention. A first is shown in a second embodiment in FIGS. 4*a* and 4*b* showing much of the same elements as in FIGS. 3*a* and *b*. There are two main differences here. Here the first radiating antenna element 28 is divided into three sections, A first section 28*a* stretches essentially sideways out from the feeding section 27 like in the first embodiment. There is however a gap provided between the first section 28*a* and the feeding section 27. There is a second section 28*b* which stretches out essentially in parallel with the first section 28*a* from the feeding section 27. The second section 28*b* then joins the first section at the first 90-degree bend, where a third section 28*c* joins them. The first bend is here a junction between the different sections. The third section 28*c* is here essentially L-shaped in the same way as in the first embodiment. The second section 28*b* here has a longer distance to the junction than the first section 28*a*. Also here there is a parasitic element 32 and a second radiating antenna element 30 in the same positions as in the first embodiment. The mechanically movable extension element 34 is here provided at the gap between the first section 28*a* and the feeding section 27. In a first fixed position the extension element 34 is provided wholly over the first section 28*a* and in a second fixed position it bridges the gap and interconnects the first section 28*a* with the feeding section 27. In the first position of the extension element 34, antenna currents run via the second section 28*b* to the third section 28*c*, where these lengths are dimensioned for the 850 MHz band. As the extension element 34 is moved to the second position, the first section 28*a* is connected to the feeding section 27. Since the first section 28*a* is shorter than the second section 28*b* antenna currents will run via the first section 28*a* to the third section 28*c* instead of via the second section 28*b*. Thus the electrical length of the first radiating antenna element combined with the extension element is here shorter and the frequency is raised to 900 MHz. Note that in this embodiment, it may be advantageous to tune the second radiating antenna element 30 to the 1900 band (PCS) and the third antenna element 32 to the 1800 (DCS) band. This will allow for improved multi-band performance, but is not an essential element of this invention.

Figure 5A:
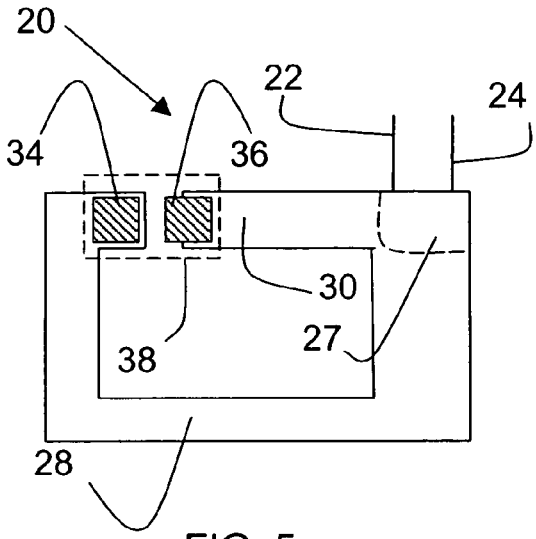
Figure 5B:
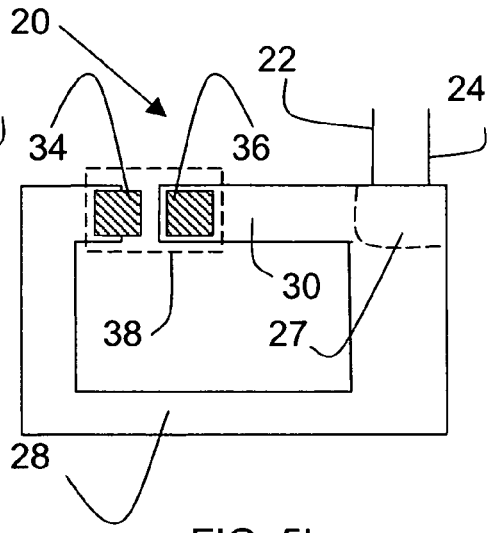
Figure 6A:
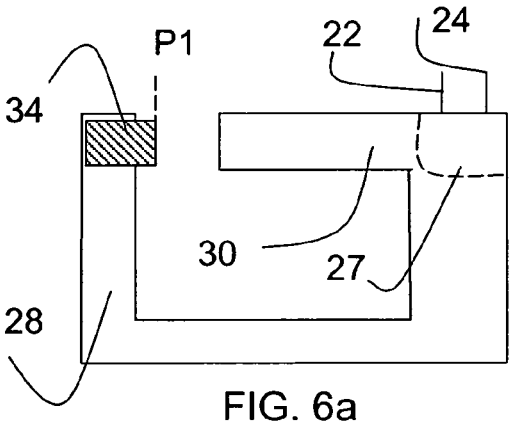
Figure 6B:
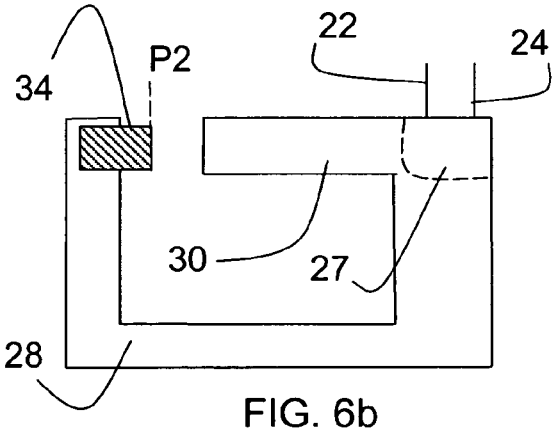
Figure 6C:
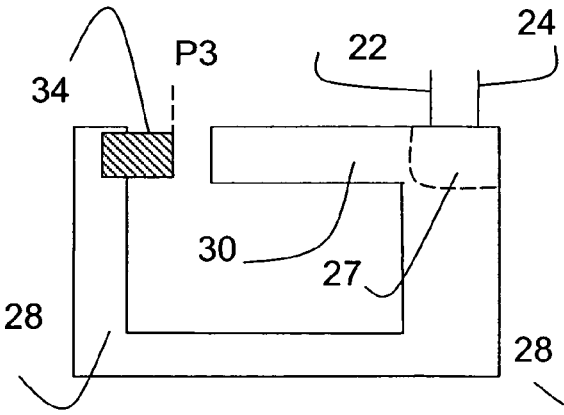
Figure 6D:
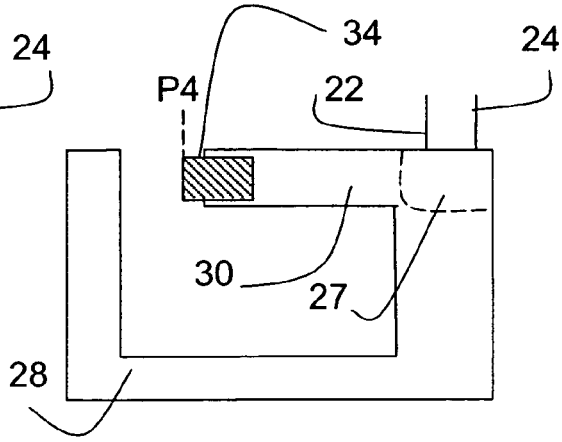

It is possible to provide embodiments of the present invention without a parasitic element. A third embodiment of the present invention, shown in FIGS. 5*a* and *b*, does not use a parasitic element. Here there is, as before, a first radiating antenna element 28, which is essentially U-shaped, where one of the legs of the U is connected to and stretches straight out from the feeding section 27. A second radiating antenna element 30 in the form of a straight bar here stretches sideways out from the feeding section 27. The free end of the second radiating antenna element 30 and the free end of the U-shaped first radiating antenna element 28 face each other. Here there is provided a first and a second mechanically movable extension element in the form of metal plates 34 and 36 on a dielectric carrier 38, where a first 34 of the plates is provided over the free end of the first radiating antenna element 28 and the other 36 is provided over the free end of the second radiating antenna element 30. In a first fixed position, FIG. 5*a*, the first extension element 34 is provided above the free end of the first radiating antenna element 28 and does not stretch out from it, while the second extension element 36 stretches out over the free end of the second radiating antenna element 30. In the second fixed position, FIG. 5*b*, the opposite situation exists. Here the first extension element 34 extends the first radiating antenna element 28, while the second 36 does not extend the second radiating antenna element 30. In the first position, FIG. 5*a*, the first antenna element is dimensioned for the 900 MHz band and is not extended, while the second extending element 36 does extend the second radiating antenna element 30 for providing 1800 MHz operation, while in the second position, the first extension element 34 extends the first radiating antenna element 28, which is then operable in the 850 MHz band, while the second extending element 36 does not influence the second radiating antenna element 30 so that it is dimensioned for use in the 1900 MHz band. Thus also here switchable multiband functionality is provided by extending antenna elements for enhancing radiation in neighbouring frequency bands.

A fourth embodiment is shown in FIGS. 6*a–d*, where one extension element 34 can be placed in several fixed positions between a first and a second radiating antenna element 28 and 30. The first and second radiating antenna elements 28 and 30 here have the same structure as in the third embodiment. This embodiment furthermore also lacks the parasitic element. In a first position, P1, the extension element 34 extends the first radiating antenna element 28 for lowering the frequency some, in a second position P2 it extends the first radiating antenna element 28 a little more for further lowering of the frequency, while in a third position, P3, it even further lowers the frequency by further lengthening the first radiating antenna element 28. In a fourth position, P4, the extension element 34 has moved over to the second radiating antenna element 30 for extending it and lowering the frequency of that element instead.

It should be realised that the extension elements of the second, third and fourth embodiments may be connected to the previously described actuating unit.

Antenna arrangements according to embodiments of the invention may have several advantages. The antenna arrangement can provide multiband functionality in a limited size antenna arrangement having a limited number of radiating antenna elements. Thus the antenna arrangement is small. The efficiencies of the different bands can be kept high. The antenna arrangement can also have low losses. The antenna arrangement may be cheap to produce, which gives a low additional cost to the end product. Furthermore there may be no power consumption associated with the extension element, which is also important for portable communication devices that are battery powered. Embodiments of the present invention furthermore may provide high gain if correctly tuned. In general, those variants which have fewer bands in a given state may have higher gain for a set volume. Accordingly, the antenna arrangements according to the third and fourth embodiments shown in FIGS. 5 and 6 may have slightly higher gain than the antenna arrangements according to the first and second embodiments shown in FIGS. 3 and 4 in a given high-band. Of course, the first and second embodiments may cover multiple high-bands without the user switching the antenna, which may be advantageous in some configurations.

A number of ways in which the present invention may be varied have been described. Several others exist. The invention can for instance be applied on other bands such as UMTS. For this reason there may also be provided more radiating antenna elements. Indeed, the bands mentioned are mere examples of bands where the invention can be used. The number of extension elements can be varied all according to how many antenna elements are to have their lengths varied. It is for instance possible to vary the first embodiment through extending the first radiating antenna element in the first position and to extend the second radiating antenna element in the second position or to only extend the second radiating antenna element and not the first. This may be combined with removal of the parasitic element or adding of a parasitic element to the first radiating antenna element. In the second embodiment it is for instance possible to provide shortening of the second radiating antenna element, either instead of or in addition to shortening of the first radiating antenna element. It is also possible to provide gaps between both the first and second section of the first radiating antenna element and make the extension element bridge one gap in a first position and the other gap in the other position. The first and second sections need not be parallel, what is important is that one is longer than the other. In the third embodiment it is for instance possible to extend both the first and second radiating antenna elements simultaneously. In order to this, the two extending elements may be actuated separately. In the fourth embodiment there may be provided more positions and then also more positions relating to extending the second radiating antenna element. The extending elements may also be provided either with turning or sliding movement and be capacitively or electrically connected to radiating antenna elements.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

The invention claimed is:

1. An antenna arrangement to be provided in the interior of a portable communication device, the antenna arrangement comprising:

at least one first radiating antenna element dimensioned for radiation in a first frequency band, and a first mechanically movable extension element, movable between at least two different fixed positions, being connected to the first radiating antenna element in at least one of the positions for radiating together with the first radiating antenna element, which extension element when being moved from one position to another adjusts the electrical length of the combined first radiating antenna and extension element for enhancing radiation in a second frequency band.

2. The antenna arrangement according to claim 1, further comprising a second radiating antenna element dimensioned for radiation in a third frequency band.

3. The antenna arrangement according to claim 2, wherein the first mechanically movable extension element is in proximity of the second radiating antenna element in one of the positions for aiding radiation of the second radiating antenna element.

4. The antenna arrangement according to claim 2, wherein the first mechanically movable extension element is in contact with the second radiating antenna element in one of the positions.

5. The antenna arrangement according to claim 2, further comprising a second mechanically movable extension element, movable between at least two different fixed positions, being connected to the second radiating antenna element in at least one of the positions for radiating together with the second radiating antenna element, which extension element when being moved from one position to another adjusts the electrical length of the combined second radiating antenna and second extension element for enhancing radiation in a fourth frequency band.

6. The antenna arrangement according to claim 5, wherein the two movable extension elements are joined to each other for simultaneous movement between different positions.

7. The antenna arrangement according to claim 1, wherein the first radiating antenna element is provided with two sections of differing lengths both provided adjacent a feeding section of the antenna arrangement and the mechanically movable extension element in one position bridges a gap between one such section and said feeding section.

8. The antenna arrangement according to claim 1, wherein the antenna arrangement is a PIFA antenna arrangement.

9. The antenna arrangement according to claim 1, wherein the mechanically movable extension element has a capacitive connection to radiating antenna elements.

10. The antenna arrangement according to claim 1, wherein the mechanically movable extension element has an electrical connection to radiating antenna elements.

11. A portable communication device comprising in its interior an antenna arrangement, the antenna arrangement including:

at least one first radiating antenna element dimensioned for radiation in a first frequency band, and a first mechanically movable extension element, movable between at least two different fixed positions, being connected to the first radiating antenna element in at least one of the positions for radiating together with the first radiating antenna element, which extension element when being moved from one position to another adjusts the electrical length of the combined first radiating antenna and extension element for enhancing radiation in a second frequency band.

12. The portable communication device according to claim 11, wherein the antenna arrangement further comprises a second radiating antenna element dimensioned for radiation in a third frequency band.

13. The portable communication device according to claim 12, wherein the first mechanically movable extension element is in proximity of the second radiating antenna element in one of the positions for aiding radiation of the second radiating antenna element.

14. The portable communication device according to claim 12, wherein the first mechanically movable extension element is in contact with the second radiating antenna element in one of the positions.

15. The portable communication device according to claim 12, wherein the antenna arrangement further comprises a second mechanically movable extension element, movable between at least two different fixed positions, being connected to the second radiating antenna element in at least one of the positions for radiating together with the second radiating antenna element, which extension element when being moved from one position to another adjusts the electrical length of the combined second radiating antenna and second extension element for enhancing radiation in a fourth frequency band.

16. The portable communication device according to claim 15, wherein the two movable extension elements are joined to each other for simultaneous movement between different positions.

17. The portable communication device according to claim 11, wherein the first radiating antenna element is provided with two sections of differing lengths both provided adjacent a feeding section of the antenna arrangement and the mechanically movable extension element in one position bridges a gap between one such section and said feeding section.

18. The portable communication device according to claim 11, wherein all movable extension elements are connected to an actuating unit, which may be actuated by a user of the device.

19. The portable communication device according to claim 18, wherein the actuating unit is provided under the casing of the device for stopping a user from actuating said extension element.

20. The portable communication device according to claim 18, wherein the actuating unit is provided on a surface of the portable communication device that is accessible to a user of the device.

21. The portable communication device according to claim 11, wherein the antenna arrangement is a PIFA antenna arrangement.

22. The portable communication device according to claim 11, wherein the mechanically movable extension element has a capacitive connection to radiating elements.

23. The portable communication device according to claim 11, wherein the mechanically movable extension element has an electrical connection to radiating elements.

24. The portable communication device according to claim 11, wherein it is a cellular phone.

* * * * *